US005863251A

United States Patent [19]

Fusco

[11] Patent Number: 5,863,251

[45] Date of Patent: Jan. 26, 1999

[54] SELF-DEFENSE DEVICE

[76] Inventor: Mark L. Fusco, 2129 Tappan Zee Ln., N.E., Palm Bay, Fla. 32905

[21] Appl. No.: 851,996

[22] Filed: May 6, 1997

[51] Int. Cl.[6] ..... F41B 15/02

[52] U.S. Cl. ..... 463/47.2; 463/47.4; 482/108

[58] Field of Search ..... 463/47.1, 47.2, 463/47.4, 47.6; 482/106, 108, 109

[56] References Cited

U.S. PATENT DOCUMENTS

| | | | |
|---|---|---|---|
| 2,099,447 | 11/1937 | Matsuyama . | |
| 4,034,982 | 7/1977 | Rupprecht et al. . | |
| 4,052,063 | 10/1977 | Wong . | |
| 4,455,023 | 6/1984 | Saloom | 463/47.2 |
| 4,460,174 | 7/1984 | Perry . | |
| 4,498,669 | 2/1985 | Chun | 463/47.2 |
| 5,454,565 | 10/1995 | Ramirez . | |

FOREIGN PATENT DOCUMENTS

WO 90/07959 7/1990 WIPO .

*Primary Examiner*—William M. Pierce

*Attorney, Agent, or Firm*—Blank Rome Comisky & McCauley LLP

[57] ABSTRACT

A self-defense device comprises a longitudinally extending shaft having a main striking knob located at one end and an alternate striking knob located at the other end, with a hooking and pressing knob disposed on a surface of the device nearest the main striking knob, and a key ring carrying portion located on an opposing surface adjacent the main striking knob. A pair of holes is provided at an intermediate portion of the device for receiving a loop to facilitate holding and using of the device. In one mode of use, the device is held so that the alternate striking knob is positioned in the palm of the hand of the user; in a second mode of use, the device is held so that a portion of the device between the main striking knob and the hooking and pressing knob is positioned in the web of the hand between the thumb and the index finger.

20 Claims, 3 Drawing Sheets

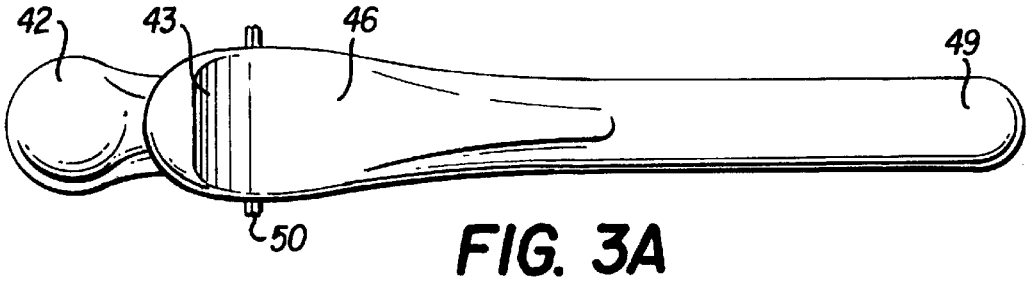
FIG. 3A
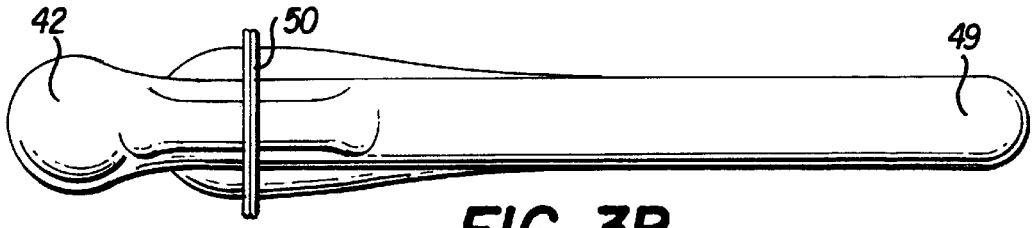
FIG. 3B
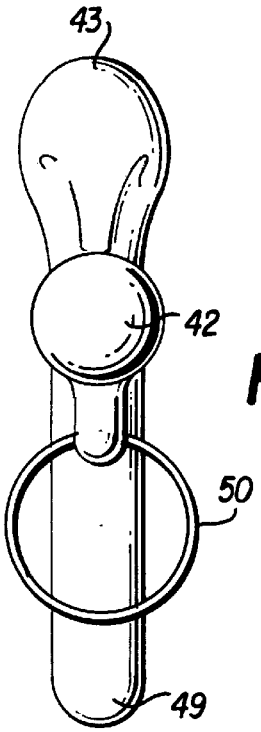
FIG. 3C
FIG. 3D
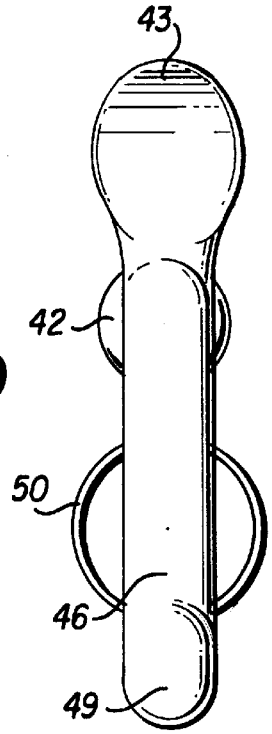

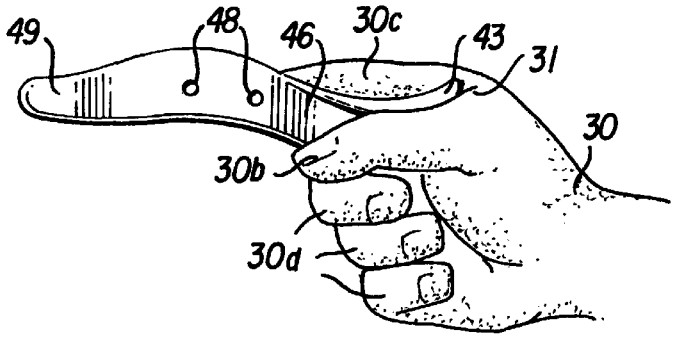
FIG. 4A
FIG. 4B
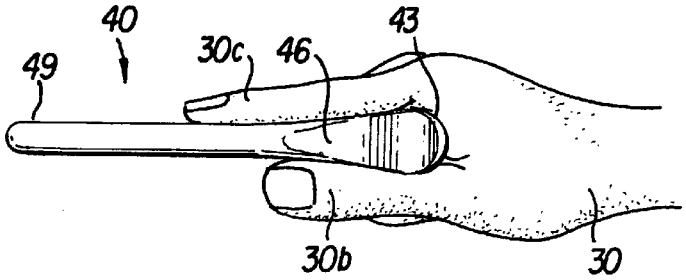
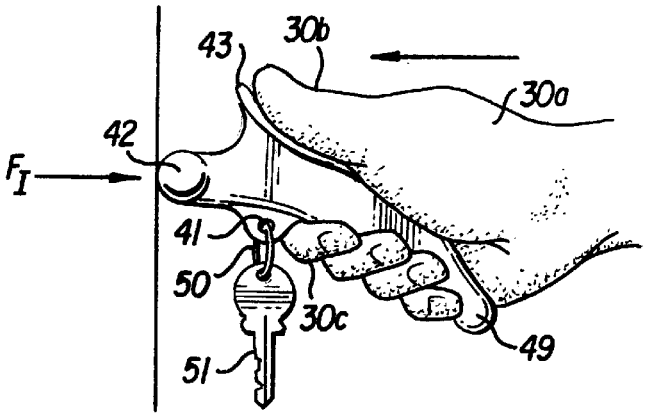
FIG. 5A
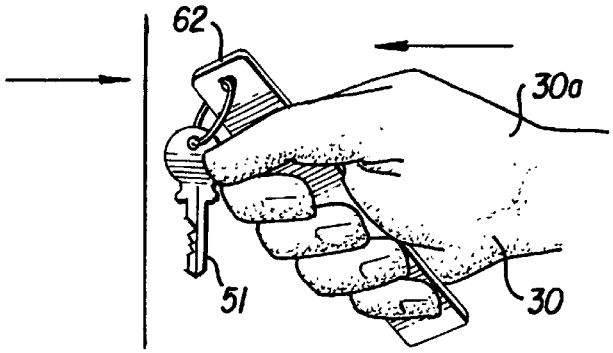
FIG. 5B
(PRIOR ART)

SELF-DEFENSE DEVICE

FIELD OF THE INVENTION

The present invention generally relates to a self-defense device, and more particularly to an effective self-defense device which is specifically designed to carry out pressure point defense techniques. Although the primary purpose of the device of the invention is to provide a self-defense implement, the device also serves a secondary purpose of providing a key carrier having defensive uses.

DESCRIPTION OF THE PRIOR ART

In recent years, the increase in crime has caused people to use and carry various weapons, such as guns and knives, for the purpose of defense. Often, the use or carrying of such weapons is illegal, and it also involves substantial liability should they be used under certain circumstances. Moreover, it is frequently not possible to carry conventional weapons in a convenient manner.

As a result of the latter circumstances, various hand-held, non-lethal weapons or devices have been developed for self-defense purposes. Typical of such devices are those disclosed in the following published international application and U.S. patents: International Publication No. WO 90/079—Wilkins; U.S. Pat. No. 2,099,447—Matsuyama; U.S. Pat. No. 4,034,982—Rupprecht et al.; U.S. Pat. No. 4,052,063—Wong; U.S. Pat. No. 4,460,174—Perry; and U.S. Pat. No. 5,454,565—Ramirez.

Devices of the prior art, such as those disclosed in the aforementioned application and patents, suffer from various disadvantages. For example, devices of the prior art are not as effective as they should be is disabling an assailant. In some cases, devices of the prior art are too large, thus making it easier for an assailant to take the device away from the defender. Certain devices of the prior art are designed in such a manner that the application of force by the defender is not as efficient as it should be, and requires the exertion of an excessive force or moment imposed on the hand, wrist or arm of the defender. In other cases, the devices of the prior art are such as to be usable only for offensive action; that is, such devices are not sufficiently flexible to permit their use in a defensive manner, such as to parry a weapon carried by the assailant.

The prior art devices are also not designed in such a manner as to facilitate effective, strong gripping of the device by the defender during its use. Some devices of the prior art are so large or long that they are incapable of being efficiently used in confined quarters. Still other devices of the prior art require substantial training in use of the device. Furthermore, even relatively smaller devices of the prior art are still large enough to preclude their being carried in a pocket or purse. Finally, certain devices of the prior art are clearly recognizable as defensive or offensive weapons with no other use, and this makes it impossible to disguise such devices so as to avoid recognition by an assailant.

In researching the history of self-defense techniques of the prior art, one encounters an ancient system of self-defense in Japan, known as "Yawara". In accordance with this system, a short stick (usually cylindrical and five to eight inches in length) is easily held in the palm of the hand. Such a palm stick has been known as "Yawara," and is commercially known as "Kubotan." The stick is used by many martial arts systems, and most systems use the same principles by employing a palm stick, a tanbo (i.e., a baton of approximately twenty-six inches in length), and a hanbo (riot baton measuring approximately thirty-six inches in length). In general, practitioners have used the self-defense principles and techniques to defend themselves with anything from a pen to an umbrella.

Nevertheless, such devices and techniques require special training. Moreover, such devices cannot be easily employed in close quarters. Finally, such devices cannot be easily concealed. Such devices do not tansfer striking energy efficiently and are not properly shaped to access certain pressure points correctly.

SUMMARY OF THE INVENTION

The present invention generally relates to a self-defense device, and more particularly to an effective self-defense device specifically usable in accordance with pressure point defense techniques. Although primarily designed as a self-defense device, the device serves a secondary purpose as a key carrier.

In accordance with the invention, the device is constructed generally in the form of a bent shaft, and has a generally oval circumference so as to prevent twisting in the hand. Preferably, the device includes a hole for a key ring, and also has two knobs and a hook for manipulation of pressure points. The surface texture of the device is such as to render it non-slipping in the hand of the user.

The self-defense device of the present invention serves as a non-lethal weapon capable of delivering disabling techniques without the use of deadly force. The device serves a secondary purpose as a key carrier having certain defensive advantages (e.g., the keys can be used in slashing in a self-defense situation), and is thus readily available for use by a defender should the need arise. The natural ergonomics of the device allow its easy use in applying greater force without exerting counter-forces or moments which would degrade the alignment of the defender's hand, wrist and arm, causing injury to the defender. The unique shape of the device enables it to fit both large and small hands. Moreover, the device is designed so as to permit it to be manipulated with only one hand.

Preferably, the device is designed to be of such a small size as to permit it to be conveniently carried, to make it harder for an assailant to wrest the device from the defender, and to permit use of the device in confined quarters where a longer weapon would be ineffective.

In accordance with the invention, the device is provided with knobs and a hook which emulate the striking surfaces on the hands, such as the finger tips and knuckles. This unique design of the inventive device is such that the device is anatomically shaped to activate each of the pressure points used for self-defense.

The device of the present invention can be made of any material with sufficient strength to withstand the impact and leverage applied when using the device and is preferably formed by a molding process such as injection molding. Moreover, the device is suitable for use not only by private citizens, but also by police in controlling and restraining subjects or suspects. Preferably, the device is designed so as to be usable with a loop which attaches the device to the user's hand, thereby permitting the user to open his or her hand without dropping the device and to parry a weapon carried by an assailant using the side of the device. Furthermore, in accordance with a preferred embodiment of the invention, raised ridges and/or friction-type material are disposed on the side surfaces of the device to improve the grip of the user.

Therefore, it is a primary object of the present invention to provide a selfdefense device, and specifically a device which can be utilized in accordance with pressure point defense techniques.

It is an additional object of the present invention to provide a self-defense device which is small in size and conveniently carried by the user.

It is an additional object of the present invention to provide a self-defense device which can be used to deliver disabling blows without the use of deadly force.

It is an additional object of the present invention to provide a self-defense device which can be manipulated with a single hand.

It is an additional object of the present invention to provide a self-defense device which, by virtue of its ergonomic design, permits the efficient application of force without the exertion of excessive and harmful force or moments on the hand, wrist or arm of the user.

It is an additional object of the present invention to provide a self-defense device which is made of material of sufficient strength to handle the leverage and impact imposed on and by the device.

It is an additional object of the present invention to provide a self-defense device which can be used with a securing loop, thereby permitting opening of the hand and parrying of a weapon carried by an assailant.

It is an additional object of the present invention to provide a self-defense device having raised ridges and/or friction-type material so as to improve the grip of the user.

It is an additional object of the present invention to provide a self-defense device which is small enough to permit it to be easily carried by the user, and to permit it to be used in confined quarters where a longer weapon would be ineffective.

The above and other objects, and the nature of the invention, will be more clearly understood by reference to the following detailed description, the associated drawings, and the appended claims.

BRIEF DESCRIPTION OF DRAWINGS

FIGS. 3A, 3B, 3C and 3D are top, bottom, left end and right end views, respectively, of the device of the present invention.

FIGS. 4A and 4B are side and top views, respectively, of the device of the present invention, as held by a user in accordance with one mode of use of the device.

FIG. 5A is a side view of the device of the present invention, as held by a user in accordance with a preferred mode of use thereof.

FIG. 5B is a side view of a prior art device held by a user, and illustrates the disadvantages of prior art devices relative to the invention.

DETAILED DESCRIPTION OF THE INVENTION

The invention will now be described in more detail with reference to the various figures of the drawings.

Figure 1:
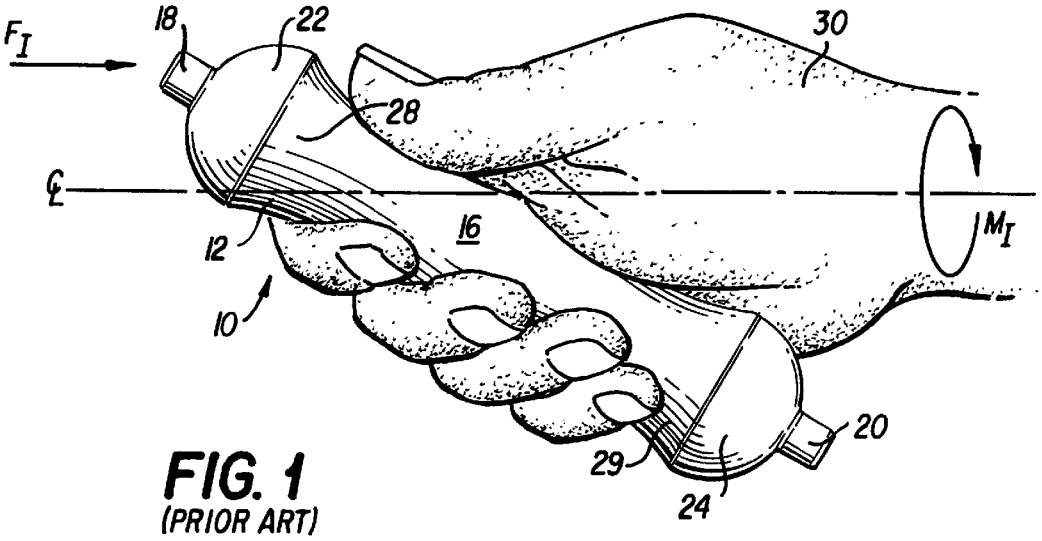
FIG. 1 (PRIOR ART)
FIG. 1 is a side view of a device of the prior art as held by the hand of a user.

FIG. 1 is a side view of a device of the prior art as held by the hand of a user. As seen therein, a hand weapon 10 is held by the hand 30 of a user, and includes a cudgel 12 having a central hand grip portion 16 and striking end portions 18 and 20. The striking end portions 18 and 20 are cylindrical projections, and they are separated from the hand grip portion 16 by stop surfaces 22 and 24, respectively. The hand grip portion 16 has abutment surfaces 28 and 29 which are adapted to be engaged by the tip of the thumb and the heel of the hand, respectively, when the weapon 10 is in use.

As is the general case with devices of the prior art, the device shown in FIG. 1 suffers from substantial disadvantages. For example, as is clear from FIG. 1, the shaft or longitudinal axis of the prior art device is not aligned with the arm of the user. This creates a moment $M_I$ at impact, the moment $M_I$ being generated by the force $F_I$ of the strike making contact with the end portion 18 of the weapon 10. Thus, the weapon 10 acts as a lever, rotating backward against the defender's wrist, so that the defender's wrist and arm absorb part of the striking energy. This can cause injury to the defender, and constitutes inefficient energy transfer in use of the prior art device. This inefficiency is not present in the inventive device, as will be explained below.

Figure 2:
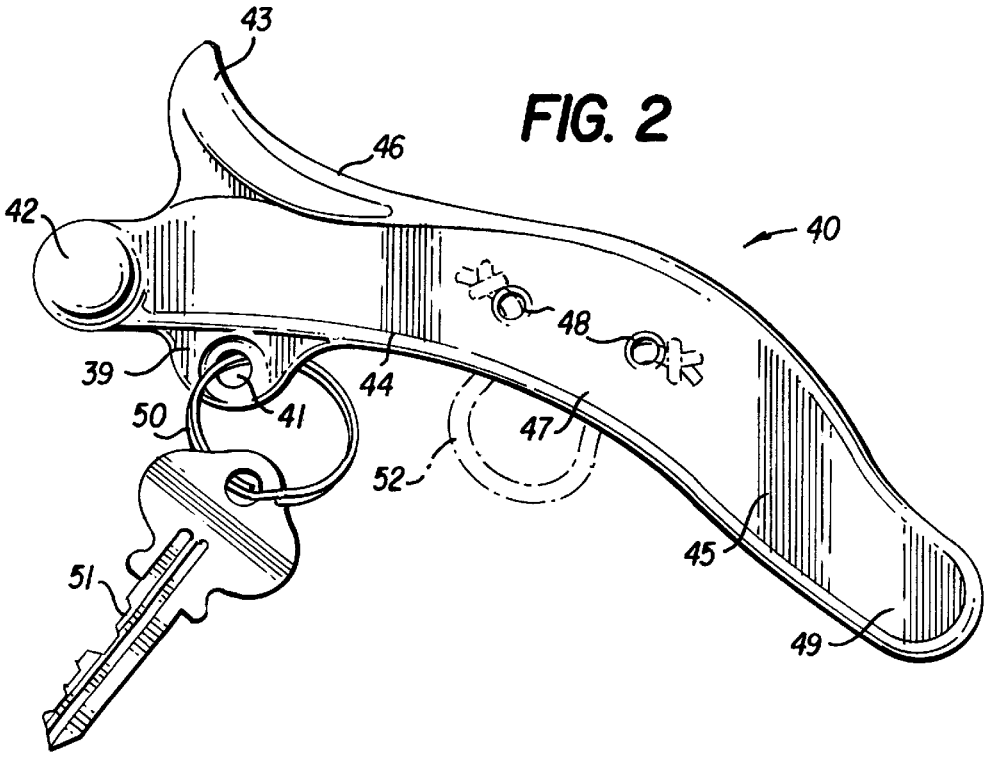
FIG. 2 is a side view of the device of the present invention.

FIG. 2 is a side view of the device of the present invention, while FIGS. 3A–3D are top, bottom, left end and right end views, respectively, of the device of the present invention. As seen therein, the self-defense device 40 comprises the following elements: a rounded tab 39 with a key ring hole 41, a main striker knob 42, a hooking and pressing knob 43, an aligned portion 44, a bent portion 45, a flattened area 46, a fulcrum point 47, holes 48, and an alternate striking knob 49.

As indicated in FIG. 2, the hole 41 is provided for the purpose of inserting a key ring 50 to which one or more keys 51 is attached. The main striking knob 42 and the hooking and pressing knob 43 have uses and functions which will be explained below. Aligned portion 44 is a part of the main shaft of the device 40 which is aligned with the main striking knob 42. The bent portion 45 is provided in order to facilitate gripping of the device 40 by the user so that the portion 44 is aligned with the wrist and arm of the user. The flattened area 46 is provided so that the thumb of the user can bear upon the back side of the hooking and pressing knob 43. The fulcrum point 47 lies along a curved portion of the device where the middle finger of the user rests when the device 40 is being held, and the holes 48 are provided as a means for connecting an elastic loop or cord 52 to the device, such loop being usable to secure the device 40 to the finger(s) or hand of the user during use. Striking knob 49 is provided as an alternate striking element of the device 40.

Further referring to FIGS. 2 and 3A–3D, the device 40 has a key ring hole 41 through which a key ring 50 is inserted, the key ring 50 holding a plurality of keys such as key 51. In this manner, the device 40 serves a secondary function as a key holder. However, the placement of the key ring 50 and keys 51 creates a pendulum-type effect. That is to say, in accordance with its primary function as a self-defense device, the device 40 can be employed by the user in a "slashing out" motion, at which point the keys 51 whip forward to strike an assailant. By the same effect, the keys will swing back when thrusting forward (see FIG. 5A).

The device 40 is also designed with a gentle curve in the area surrounding the fulcrum point 47 (see FIG. 2)—that is, the area between aligned portion 44 and bent portion 45. By wrapping the middle finger around point 47, the user can create a fulcrum effect so that the area in the vicinity of portion 45 becomes a lever relative to the fulcrum. The curved portion between portions 44 and 45 permits point 47 to be at different locations dependent upon the size of the user's hand. Accordingly, if the user pulls at point 45 using the ring and little fingers and pushes at area 46 using the thumb, a forward rocking motion is created. This motion, when coupled with snapping of the wrist downward in the direction of the little finger, adds force and focuses more energy at the striker knob 42. This method permits the striker knob 42 to be in proper alignment with the bones in the arm of the user for maximum energy transfer, and prevents injury to the wrist 30*a* of the user (see FIG. 5A). This should be contrasted with conventional devices of the prior art, such as that disclosed in FIG. 5B. With respect to such a prior art device, it should be noted that, as shown in FIG. 5B, the striking surface 62 is not in proper alignment with the bones in the arm 30 for maximum energy transfer, and injury to the wrist 30*a* of the user is likely.

As is well-known in the field of martial arts and self-defense techniques, pressure points are areas where nerves end in the skin, or where they branch or cross. When such points are struck, pressed or rubbed at the proper angle and with a correctly sized and shaped object, the result is pain, weakened muscles, manipulated joints, or disorientation or unconsciousness. Referring to FIG. 2, knobs 42, 43 and 49 have been designed to facilitate proper striking, pressing, hooking and rubbing of vital pressure points. The unique spacing between knobs 42 and 43 permits the simultaneous activation of two points, such as the points on the neck, or points on the stomach, for special defensive techniques. Another purpose of the spacing between knobs 42 and 43 results from an alternative use of the device 40.

Referring to FIGS. 4A and 4B, the user inverts the device 40 end-for-end and positions the web 31 of the hand (located between the thumb and index finger) between the knobs 42 and 43 of the device 40. The shaft of the device 40 is then gripped between the thumb 30*b* and index finger 30*c* of the user, with the rest of the fingers 30*d* wrapped around the ring 50 and keys 51. The bend in the shaft of device 40 (in the vicinity between portions 44 and 45 of FIG. 2) increases the reach of the user and provides a correct angle for thrusting into pressure points of an assailant, such as the pressure points at the base of the throat above the collar bone. Nevertheless, it is still possible while palming the device to strike the assailant with a normal fist, or to chop with the edge of the hand 30. The device 40 is also especially suited for controlling and trapping appendages with one hand. For example, when using the device in the manner shown in FIG. 5A the user can squeeze the wrist of an assailant between the thumb 30*b* and the flattened area 46 of the device 40. The hooking and pressing knob 43 provides a stop to help close the escape gap, or it can be used to dig into vital pressure points. The various knobs 42, 43 and 49 on the shaft or spine of the device 40 can be used to massage pressure points as well for health purposes.

In accordance with a preferred embodiment of the invention, an elastic band or cord 52 can be inserted successively through holes 48 of the device 40, and then tied into a closed loop. By placing the elastic band or cord 52 through the holes 48, a loop is created for the middle finger of the user. This assists with retention of device 40 during use, if so desired, and also permits the user to open his or her hand to slap with the device across vital points, or to deflect a weapon. An elastic band is preferred since it will stretch, thereby permitting the user to remove his or her finger if the device 40 is grabbed by an assailant.

It should also be noted that, with respect to the size of the device 40, the length of the shaft of the device 40 between knobs 42 and 43, on the one hand, and knob 49, on the other hand, can be increased so that the device 40 fulfills a purpose or role as a baton, while still maintaining the use of the knobs 42 and 43.

In contrast to devices of the prior art, it should be noted that the device 40 is a one-sided weapon. The unique shape of the device 40 makes it less likely that an untrained person will immediately understand how to employ the device against a person who has dropped it. Thus, if the device is dropped by the user during use, the assailant who picks up the device will not be able to readily use the device effectively against the user.

It should be noted that, whereas a stick-shaped object of the prior art (such as the device 62 shown in FIG. 5B) is familiar looking to the average person, the unique shape of the device 40 of the present invention invokes thoughts of a design and/or use which could indicate specialized training on the part of the user. Thus, the unique construction and design of the device 40 can serve as a psychological deterrent to an aggressor.

Further contrasting the device 40 with the prior art, a conventional palm stick or Kubotan (such as the device 62 shown in FIG. 5B) is such that, if the latter is employed with keys, it is possible to get the keys trapped between the hand of the defender or user and the body of the attacker or assailant. This can cause an unwanted injury to the user.

In contrast to the devices of the prior art, the knobs 42, 43 and 49 of the device 40 (FIG. 2) have been specifically sized and shaped to fit the anatomical form of each pressure point used in typical self-defense techniques (as guided and set forth by the art of Kyusho and Tuite jitsu from Ryukyu Kempo). This also permits pressure points to be accessed to aid in Acupressure massage for the purposes of healing.

The provision of the hooking and pressing knob 43 in the device 40 permits an attacker's appendage, such as the wrist, to be grabbed and controlled with one hand by the user of the device 40. Knob 43 assists in closing off any escape gap. An additional advantage resides in the fact that the knob 43 can be dug into pressure points of an assailant while controlling the appendage (and this is especially suitable for the hand and wrist).

The gentle curved portion of the device between portions 44 and 45 of FIG. 2 (as previously discussed) permits a lever-type effect to occur at fulcrum point 47, and the resulting effect focuses greater force at the knob 42 when striking an assailant. Moreover, the gentle curve allows different sized hands to naturally fit to the device 40 and to create their own fulcrum point.

The rocking action of the device described previously aligns the knob 42 and portion 44 of the device 40 (FIG. 2) with the bones of the arm of the user for maximum energy transfer. The shaft of a palm stick-Kubotan and other prior art devices are not so aligned with the arm of the user, so that they create a moment at impact. This disadvantage is present in the weapon described in International Publication No. WO 90/07959 of Wilkins, as mentioned above and as illustrated in the prior art arrangement of FIG. 1. The moment created at impact is the force of the strike making contact with the end of the stick; that is, the stick acts as a lever rotating back against the defender's wrist. Thus, the defender's wrist and arm absorb part of the striking energy. This is not efficient and is in stark contrast to the device 40 of FIG. 5A. In the prior international publication, Wilkins claims that "the grip is engaged with the hand being in a hand shaking position with the thumb extended so that it is in line with the user's forearm . . . " (page 2, line 16 of the publication). With respect to FIG. 5 of the publication, if the arm is thrusting out parallel to the ground, knob 18 (FIG. 1) is above the forearm and creates a moment. In contrast, in accordance with the present invention, during the thrusting out motion, the knob 42 is in alignment with the wrist 30*a* of the user (FIG. 5A).

Unique to the design of the present invention is the ability to use it to attack two pressure points or nerve centers at the same time, using knobs 42 and 43. Moreover, the device can be turned around, as described above relative to FIGS. 4A and 4B, so as to increase reach and attack additional pressure points with proper angle, shape and size. Furthermore, as described above, the device is designed with holes 48 for insertion of a loop so as to provide for retention of the device 40 and use of additional techniques when desired by the user.

Extending bent portion 45 adds versatility to the device 40 in that it can be used as a baton without changing the manner of use of knobs 42 and 43. Little or no additional training is required to transfer to the extended version. This version is more versatile than a regular baton or stick because of the employment of striking knob 42 and hooking and pressing knob 43.

It should be noted that, with reference to FIG. 2, the tab 39 of the device 40 has a rounded periphery. In another embodiment of the invention, the rounded surface of the tab 39 may be in the form of a squared-off surface. This has a particular advantage when the device is used in the mode shown in FIG. 5A. That is to say, if the device 40 is employed in the manner shown in FIG. 5A, squaring off of the tab 39 surrounding the hole 41 provides a firm structural abutment against which the index finger 30*c* of the user's hand can be positioned. This will result in a substantial increase in the ability of the user to hold on to, and to retain control of, the device 40 when striking with the device 40.

The device 40 is preferably molded of a suitable plastic material. To improve the gripping of the device, the mold surfaces may be provided with grooves or ridges so as to form knurl-like surfaces on the device or the mold surfaces may otherwise be textured to provide rough surfaces on those portions of the device that contact the hand of the user.

While preferred forms and arrangements have been shown in illustrating the invention, it is to be understood that various changes and modifications may be made without departing from the spirit and scope of this disclosure.

What is claimed is:

1. A self-defense device adapted to fit in a hand of a user comprising:

a longitudinally extending shaft having a first end and a second end, said shaft comprising an aligned portion having a longitudinal axis and a bent portion having a longitudinal axis, the longitudinal axis of the bent portion being arranged at a fixed angle with respect to the longitudinal axis of the aligned portion;

a main striking knob disposed at said first end; and a hooking and pressing knob disposed on a surface of said aligned portion at a point between said first and second ends, said main striking knob and said hooking and pressing knob being integrally formed with said shaft in a fixed, nonarticulatable relation with respect to one another, said hooking and pressing knob comprising a protrusion extending in a first direction away from the surface of said aligned portion, said protrusion having a flattened portion of sufficient surface area to engage a thumb of the user.

2. The device of claim 1, wherein said main striking knob comprises a protrusion extending in a direction generally parallel to the longitudinal axis of said aligned portion.

3. The device of claim 1, further comprising a key ring carrying portion located on said aligned portion and extending away from the surface of said aligned portion in a second direction opposite said first direction.

4. The device of claim 3, wherein said key ring carrying portion has an aperture formed therein for receiving a key ring.

5. The device of claim 1, including a pair of holes formed in said shaft and a loop extending through said holes for engaging a finger or hand of the user to facilitate gripping the shaft.

6. The device of claim 1, wherein said shaft has a curved portion extending between and connecting said aligned portion with said bent portion.

7. The device of claim 1, further comprising an alternate striking knob disposed at said second end and being integrally formed with said shaft in a fixed, nonarticulatable relation with respect to said main striking knob and said hooking and pressing knob.

8. A self-defense device adapted to fit in a hand of a user comprising a shaft formed in one piece and having first and second shaft portions each with a longitudinal axis, the longitudinal axes of said first and second shaft portions being disposed at a fixed, nonarticulatable angle with respect to one another, said first shaft portion having a free end, a main striking knob integrally formed on the free end of said first shaft portion, a hooking and pressing knob integrally formed on said first shaft portion spaced from said main striking knob, and a flattened area disposed on said first shaft portion adjacent said hooking and pressing knob and facing away from the longitudinal axis of the first shaft portion, said second shaft portion having a free end, an alternate striking knob integrally formed on the free end of said second shaft portion, said main striking knob, hooking and pressing knob and alternate striking knob being in fixed, nonarticulatable relation with respect to one another.

9. The device of claim 8, including a curved fulcrum portion disposed between and connecting said first and second shaft portions.

10. The device of claim 8, wherein said shaft portions are generally oval-shaped in cross-section so as to prevent twisting of the shaft when gripped by the hand of the user.

11. The device of claim 8, wherein said main and alternate striking knobs have rounded surfaces.

12. The device of claim 8, including a tab disposed on said first shaft portion on a side thereof opposite said hooking and pressing knob.

13. The device of claim 12, wherein said tab has an aperture therein for receiving a key ring.

14. The device of claim 12, wherein said tab has an abutment surface against which an index finger of the user is adapted to bear.

15. The device of claim 8, including a pair of holes formed in said shaft and a cord loop affixed in said holes.

16. The device of claim 8, wherein said shaft together with said main striking knob, hooking and pressing knob and alternate striking knob are integrally molded in one piece of plastic.

17. The device of claim 8, wherein at least some surfaces of said shaft are provided with anti-friction means for improving the gripping of the device in a hand of a user.

18. The device of claim 8, wherein said flattened area curves upwardly toward said hooking and pressing knob from an intermediate portion of said shaft.

19. A self-defense device integrally molded and formed in one piece of a plastic material and adapted to fit in a hand of a user comprising a shaft having a generally oval-shaped cross-section so as to inhibit twisting of the shaft in the hand of the user, said shaft comprising first and second shaft portions each with a longitudinal axis, the longitudinal axis of said first shaft portion being disposed at a fixed angle with respect to the longitudinal axis of said second shaft portion, said first shaft portion having a free end, a main striking knob integrally molded on the free end of said first shaft portion, a hooking and pressing knob integrally molded on said first shaft portion spaced from said main striking knob, and a flattened area disposed on said first shaft portion adjacent said hooking and pressing knob, said flattened area curving away from the longitudinal axis of the first shaft portion in a direction toward the free end thereof, said second shaft portion having a free end, an alternate striking knob integrally molded on the free end of said second shaft portion, said main striking knob, hooking and pressing knob and alternate striking knob being in fixed, nonarticulatable relation with respect to one another.

20. The self-defense device of claim 19, wherein the fixed angle between the longitudinal axes of said first and second shaft portions is selected such that when the second shaft portion is gripped in the palm of the hand of the user and the thumb of the user is pressed against the flattened area, the first shaft portion is oriented substantially parallel to the forearm of the user.

* * * * *